US006733347B2

(12) United States Patent
Palet Mercader et al.

(10) Patent No.: US 6,733,347 B2
(45) Date of Patent: May 11, 2004

(54) FAST CONNECTING SYSTEM FOR ELECTRICAL OR ELECTRONIC DEVICES WITH INTERCHANGEABLE COMMON ELEMENTS

(75) Inventors: Marti Palet Mercader, Barcelona (ES); Miguel Ortiz Gimenez, Barcelona (ES)

(73) Assignee: GE Power Controls Iberica, S.L., Terrassa (ES)

( * ) Notice: Subject to any disclaimer, the term of this patent is extended or adjusted under 35 U.S.C. 154(b) by 0 days.

(21) Appl. No.: 10/235,448

(22) Filed: Sep. 5, 2002

(65) Prior Publication Data

US 2003/0049973 A1 Mar. 13, 2003

(30) Foreign Application Priority Data

Sep. 7, 2001 (ES) ..... P200102022

(51) Int. Cl.[7] ..... H01R 4/36
(52) U.S. Cl. ..... 439/810
(58) Field of Search ..... 439/810, 812, 439/813

(56) References Cited

U.S. PATENT DOCUMENTS 6,437,671 B1 * 8/2002 Gula et al. ..... 335/202
6,531,941 B1 * 3/2003 Greenberg et al. ..... 335/202

* cited by examiner

*Primary Examiner*—Hung V. Ngo
(74) *Attorney, Agent, or Firm*—Klauber & Jackson

(57) ABSTRACT

This system is applicable to the connection and assembly between electric or electronic modules or devices (1 and 2) which are fitted with input and output connectors installed in corresponding bases which are supplemented with protective covers installed on the connector input and output sections proper. The novelty consists of the input connector sections (5) of the module (2) including, reproduced and integrated, the base (7) and cover (8) of the output connector section (4) of the module (1), as a result of which these bases (7) and cover (8) of the module (1) can be changed over to the output connector sections (6) of the module (2), it therefore being possible for this module to be supplied without said base and cover. Additionally, a fast system for connecting and attaching the two modules (1 and 2) to one another has been provided based on the screws (16) which make the connection and attachment between the terminals of the two modules (1 and 2), are mounted on springs (18) which keep them open and facing the openings through which the connector terminals proper are put in and screwed into place. These modules can be concatenated, in other words, whatever number of modules may be desired or may be necessary depending upon their intended use, can be connected to each other one after the other.

4 Claims, 8 Drawing Sheets

FAST CONNECTING SYSTEM FOR ELECTRICAL OR ELECTRONIC DEVICES WITH INTERCHANGEABLE COMMON ELEMENTS

BACKGROUND OF THE INVENTION

The present invention relates generally to the area of devices for the electrical connection between various electrical equipment, appliances, and the like, and particularly to such devices as have common and interchangeable elements.

For the protection of electric distribution circuits, devices are used which are usually comprised of two devices or modules, one of which is comprised of a switch and the other being comprised of a differential line-to-ground fault protection relay, both incorporating one section for input connectors and another section for output connectors, such that each one of these sections is equipped with a base on which the connectors are installed and, in some cases, a protective cover with access openings for being able to manipulate the connectors in question, specifically the screws which are to secure the terminals of the connectors, using an appropriate tool.

Conventionally, in this type of modules, the base on which both the input and the output connectors are installed are usually removable in order to be able to mount either one type of connectors or another depending upon the application or use of the devices or devices. Additionally, in the sections in which the two modules are attached or coupled to one another, the corresponding output connectors of the circuits breaker module and input connector of the differential module include supplementary elements so that, on making the attachment, common connectors are set up in order to make wire the two modules to one another.

On the other hand, the protective covers provided on these modules are fixed, in other words, they are an integral part of the module, preventing their removal, which prevents or hinders the corresponding mounting or attachment of the different types of conductors and/or strips.

Based upon that which has been set forth hereinabove, for the two modules to be electrically connected to one another, four parts are obviously required, two of these parts corresponding to the bases and the other two corresponding to the covers. These four parts entail a monetary cost in the production or manufacture thereof, apart from the amount of time employed in their mounting and of the amount of time taken to make the attachment between the two modules, not to mention that the securing of the terminals by means of the corresponding screws normally involves a number of problems and inconveniences for the person performing this task, who is sometimes confronted with the screws falling out just when starting the screwing procedure, one screw or another even possibly being lost in the process.

SUMMARY OF THE INVENTION

The present invention involves a system for the fast connection of electric or electronic devices with common interchangeable elements, in which the devices are comprised by each one of the modules fitted with input connectors for connecting to other devices or equipment, and output connectors for their connection to another module by means of input connectors incorporated in the latter of the two modules. Both modules are fitted with respective protective covers for the aforementioned connectors, with openings for accessing them.

The object of this invention is to provide a system in which, in the input connector section of one of the modules, the protective cover and base pertaining to the other module are integrated and reproduced, as a result of which these modules can be mounted in the output connector section of the previous module, thus making it possible for this previous module to be supplied without said protective cover and base, and making it possible for the two modules to be fit together and connected to one another following the dismantling of the aforementioned protective cover and base of the module into which they are initially incorporated.

Another object of this invention is that of providing a fast system for connecting and attaching these two modules based on the fact that the screws by means of which the connections among terminals and corresponding attachment are made are mounted on springs which keeps them guides and positioned in an open setting facing the holes through which the terminals are installed and screwed into place in order to easily make the aforementioned connections and attachment in an easy, fast manner.

Therefore, this system can be said to be structurally resolved by way of a reduction of components, providing for monetary savings for the manufacturer and, therefore, for users, as well as cutting down on the amount of time required for the connection and/or attachment between modules.

This system is preferably applicable to those devices or modules comprised of a differential line-to-ground fault protection relay and an automatic circuit breaker, which are mounted on electrical distribution circuit to safeguard against over-currents caused by any type of electrical fault or fluctuation, being likewise applicable to other electric or electronic devices or devices in which the use thereof is required or is feasible.

Based upon its structural features, this system makes it possible to connect modules in a concatenated connection one after the other.

DESCRIPTION OF THE INVENTION

The system comprising the object of the invention is designed in order to be able to easily, rapidly and efficiently make the electrical connection and, at the same time, the attachment among electrical modules or devices by employing fewer parts than those conventionally required, these parts being confined to one single base and to a protective cover instead of the two bases and the two covers which are conventionally required.

The system which is being proposed hereunder, being applicable to the type of modules or devices to which reference has previously been made hereinabove, in which one modules is going to be considered hereinafter as the first module, and the other is going to be considered as the second module, has the unique feature that, in the first module, both the bases on which the corresponding connectors are installed as well as the respective protective covers are removable, interchangeable and mountable on the output connector section of the second module, making it possible for the second module to be sold without said output connectors, given that the bases on which the outlet connectors of the first module are mounted can be mounted in its section following its removal from the first module.

For this purpose, one of the fundamental features of this invention is that, in the section of the input connectors of the second module, the base and the protective cover of the first module are reproduced and integrated, as a result of which said base and protective cover can be removed from said first module and be mounted in the output connector section of the second module, making it possible for the second module to be supplied without said base and cover.

Apart from this, another novel features is the fact that the screws used for connecting and securing the terminals corresponding to the connectors of the input section of the second module are mounted in a permanently open position, in other words, toward the position in which the screw does not fasten the terminals corresponding to the two modules to one another, the permanently open set position of the screw which holds the terminals in place being achieved by means of a spring, in combination with a pronged washer forming a sort of housing, which is positioned at the upper end of the spring and which serves as support and as a retainer from the head of the screw which is lodged concentrically to the spring, all of which is located on the inside of a guide part or cover which is mounted independently in a mortise provided for this purpose in the corresponding input connector section of the second module. Therefore, the electrical connection can be made simply, rapidly and efficiently at the same time as the attachment among the modules in which the system of the invention is applicable, whilst at the same time achieving the advantage of it being possible for the second module to be sold without the base and the protection cover corresponding to the output connector section, given that these elements will be removed from the first module and mounted in the output connector section of the second module.

Likewise, special mention may be made of the fact that, as a result of the protective covers being removable, the handling of the attachment and wiring connections can be done more easily and conveniently.

One further advantage consists of the set screws of the terminals corresponding to the connectors for connecting the modules are integrated into the second module, as a result of which the typical loss or dropping of the screws proper will be prevented, whilst, at the same time, it is not necessary to screw in the screws by feel, given that, as has previously been mentioned hereinabove, the screws are duly guided and are previously positioned such that, by exerting pressure on them using the corresponding tool and by actuating the tool, the corresponding terminals are screwed and secured into place.

Lastly, for the connection and attachment of the modules, provision has been made for the modules to be supplement with a top cover in between to both protect the section in question and to conceal the intersection openings made in attachment of the two modules, and as a finishing or ornamentation, which provides a better aesthetic appearance on the attachment between the two modules.

BRIEF DESCRIPTION OF THE DRAWINGS

To complete the description which is going to be made in following and for the purpose of aiding in a better comprehension of the features of this invention, a set of drawings is attached to this descriptive account, based on which the innovations and advantages of the system comprising the object of the invention may be more easily understood.

DESCRIPTION OF AN EMBODIMENT OF THE INVENTION

Figure 1:
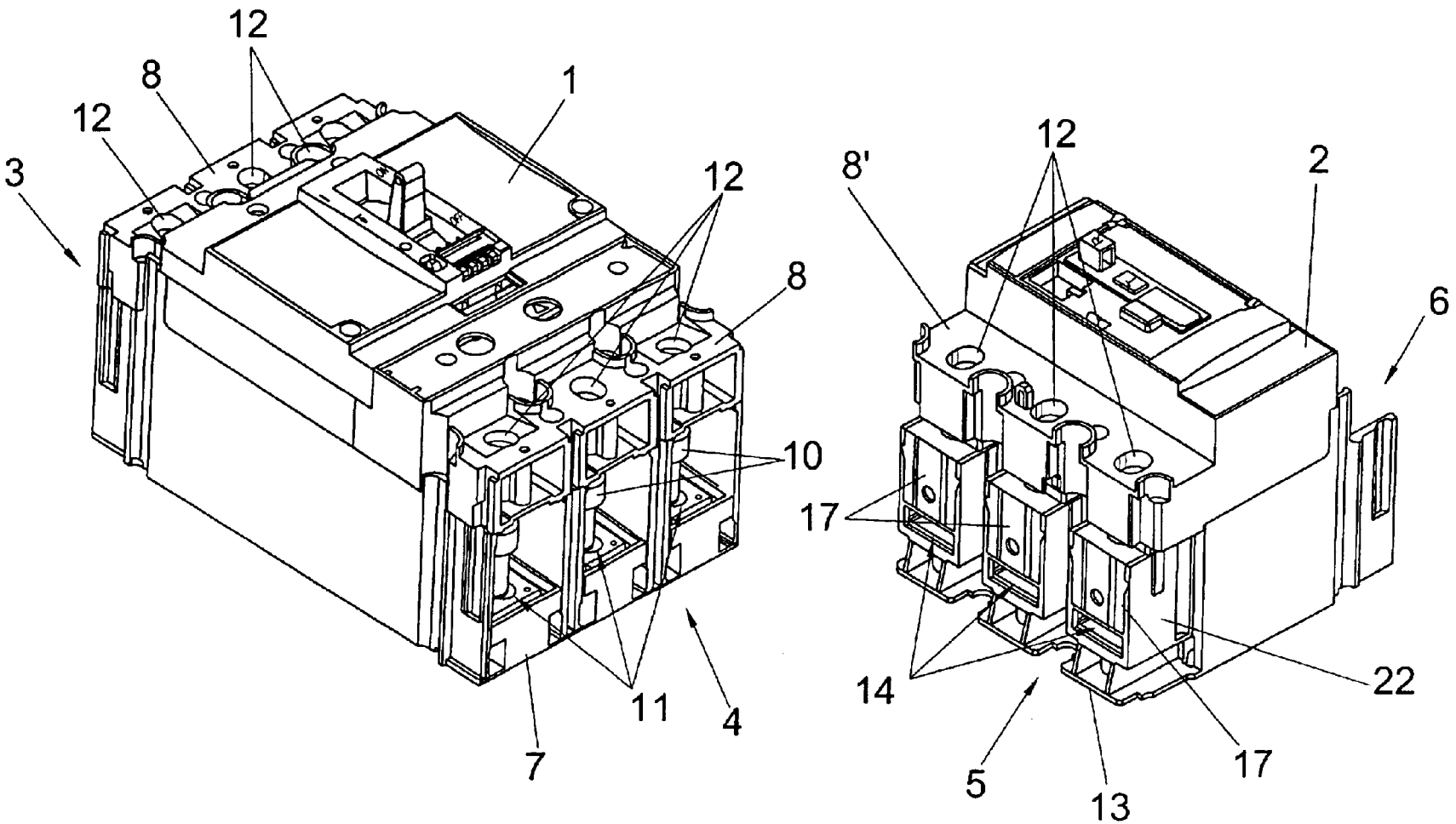
FIG. 1. Showing a depiction from one perspective view of the basic and supplementary modules, separate from one another, exactly as they are supplied to the user, for making their connection and attachment.

In the aforesaid figures, modules 1 and 2 which are to be connected and attached to one another are shown. Module 1 comprised one part or section 3 corresponding to the input connector are, and an opposite part or section 4 corresponding to the output connectors, while module 2 includes one part or section 5 corresponding to input connectors and one part or section 6 corresponding to output connectors.

Module 1 incorporates in said input 3 and output 4 sections, respective bases 7 and protective covers 8, the bases 7 being the same and interchangeable, just like the aforementioned protective covers 8.

The bases 7 incorporates the corresponding screws 9 into which the setscrews 10 of the terminals 11 are to be screwed, terminals 11 being permanent elements, whilst the nuts 9 with the screws 10 are always attached to the corresponding base 7. The nuts 9 with the screws 10 and terminals 11 comprised in each case the corresponding module connectors.

Although the modules have been shown with three poles in the drawings, they could undoubtedly have four or any other appropriate number of poles.

The protective covers 8 are fitted with openings 12 to make it possible to insert an appropriate tool and to turn the setscrews 10 for attaching to the terminals for the purpose of being able to perform the screwing or unscrewing of said screws.

Figure 2:
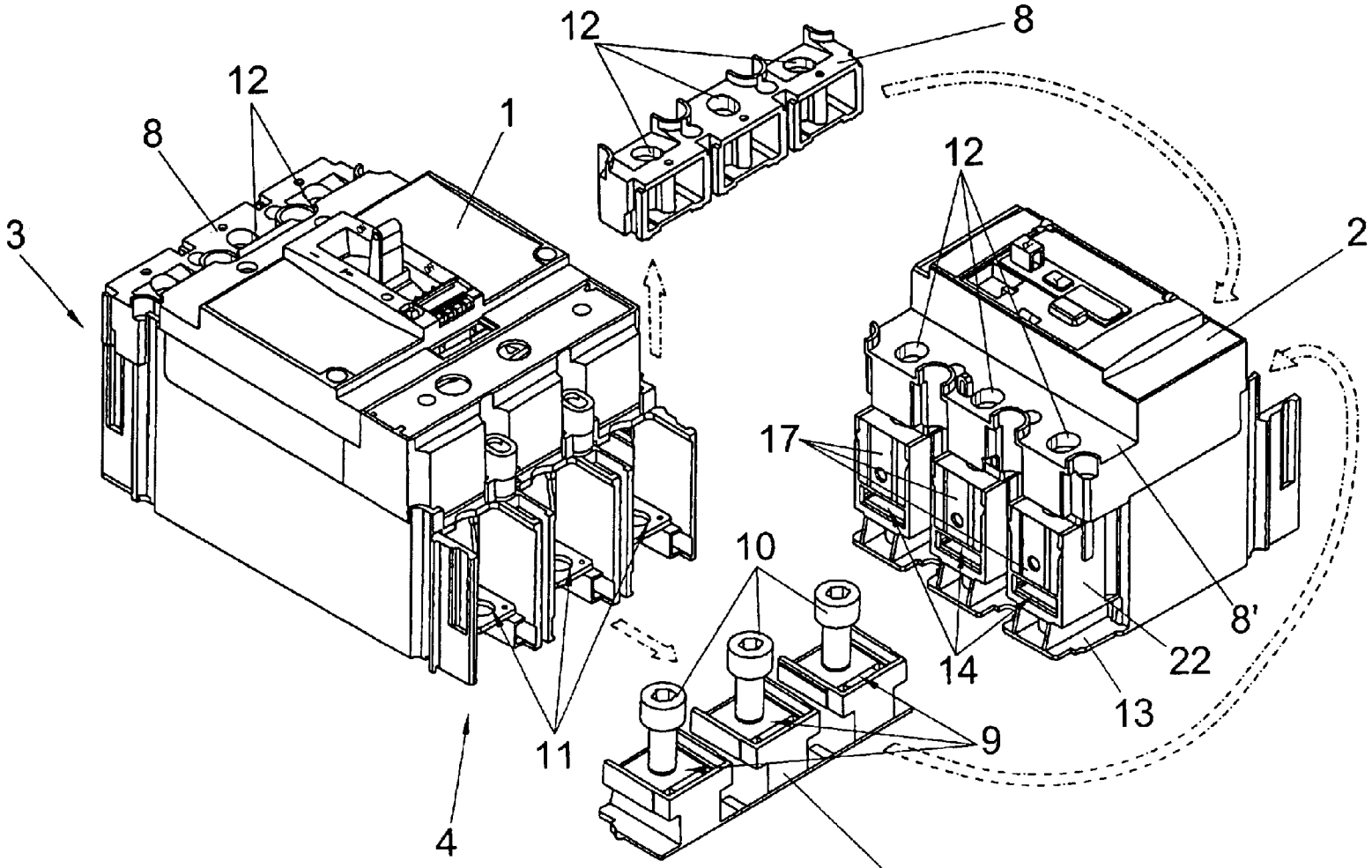
FIG. 2. Showing a likewise perspective view of the same basic and supplementary modules shown in the figure above, in which it can be seen how the base holding the screws onto which the setscrews of the terminals are screwed has been separated from the output connector section of the basic module, as well as the corresponding protective cover of the basic module, the arrows shown in this figure indicating the sections from which these two elements are removed as well as the section in which these elements are mounted on the corresponding supplementary module.

FIG. 2 shows module 1 following the removal of its base 7 and respective protective cover 8 corresponding to output connector section 4, arrows being shown in this FIG. 2 indicating the sections of module 2 where said base 7 and protective cover 8 are to be installed. On its part, said module 2 incorporates in input section 5 the corresponding connectors integrated into said module, the connectors of which are located on a lower base 13 which is fixed and forms an integral part of module 2, each connector being comprised, in this case, of a nut 14 with the corresponding threaded hold 15, as well as a screw 16 which is mounted in a guided manner on a part 17 in the form of an upside-down housing serving as a protective cover and as a cover for said screw 16, as well as a spring 18 which keeps it constantly pushed upward, the screw 16 resting on a washer 19 with prongs 20 forming a sort of positioning housing on the inside of the spring 18 and holding said spring in place, the stem of screw 16 being housed concentrically inside the spring 18 with its head resting precisely on the housing formed by washer 19. The part which serves the purpose of a protective cover 17 has a hole at the top 21 for inserting screw 16 for screwing it into place.

This assembly, which determines the corresponding connector in module 2, forms in each case, an integrated connector which is located in a mortise 22 provided for this purpose in module 2 proper, corresponding to input connector section 5. In this case, the protection of the connectors is provided by means of a cover 8' which is an integral part of module 2 proper, as is shown in the corresponding figures, the cover 8' of which, just the same at the protective covers 8, has openings or holes 12 for accessing the screws 16 of the connectors.

Therefore, according to that which has previously been explained hereinabove, mode 1 and module 2 are supplied exactly as they are shown in FIG. 1, in other words, module 1 with its corresponding bases 7 as well as the respective protective covers 8, whilst module 2 is supplied solely with the base 13 and cover 8', which are fixed and correspond to input connector section or part 5, module 2 not having the base and cover corresponding to output connector section 6.

However, based on that which is shown in FIG. 1, in order to connect and attach module 1 to module 2, the first thing which is done it to remove base 7 corresponding to output connector section 4 of module 1 and cover 8 from this same section, leaving the terminals 11 free as is shown in FIG. 2.

Next, said base 7 is attached with nuts 9 and screws 10, in output connector section 6 of module 2, setting up, in conjunction with the fixed terminals on this side of module 2, the corresponding output connectors of module 2. Protective cover 8 is also installed in this section.

Figure 3:
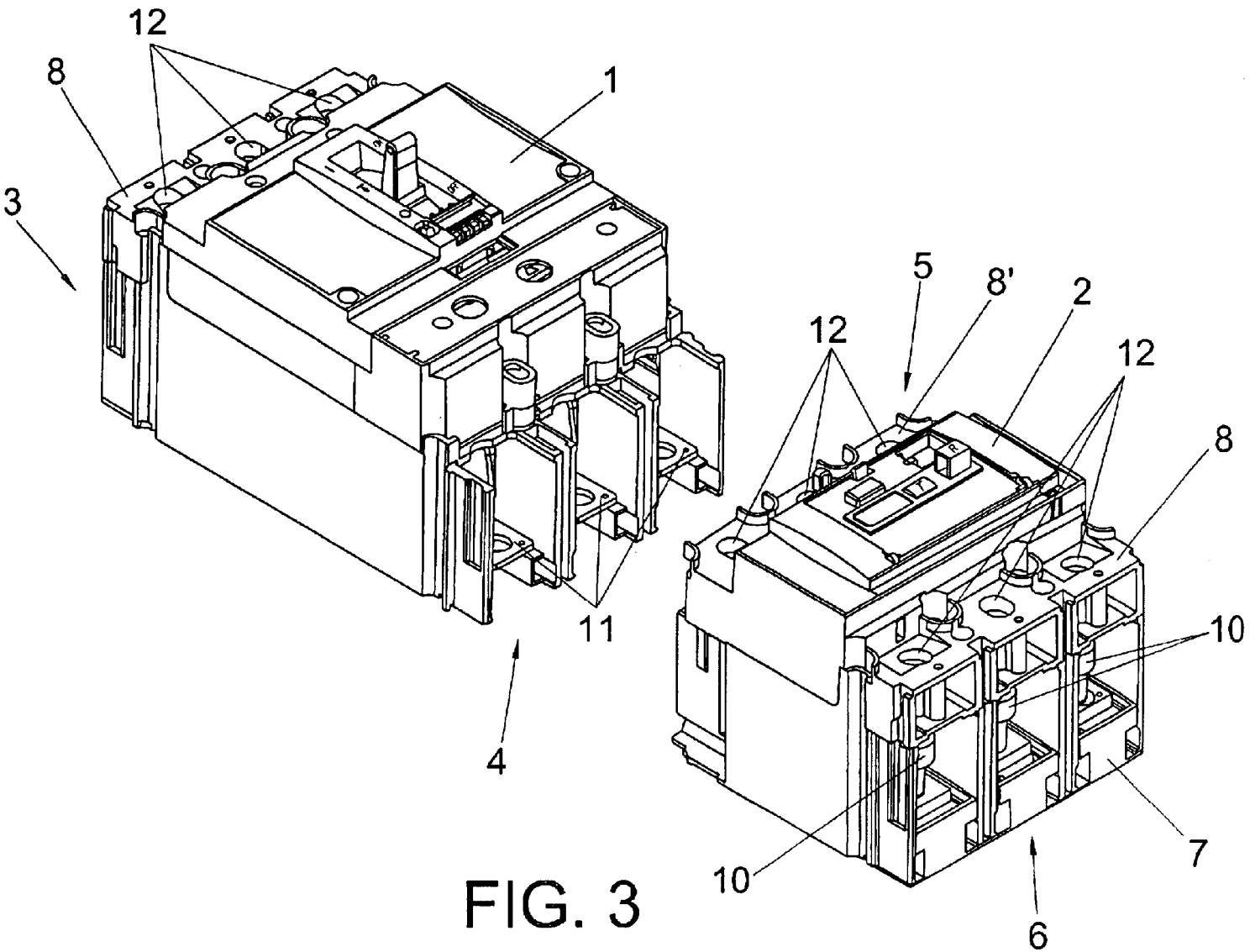
FIG. 3. Showing a perspective view of the two modules facing one another for making their connection and attachment, the supplementary module incorporating the corresponding protective cover and base which have previously been removed from the basic module.
Figure 4:
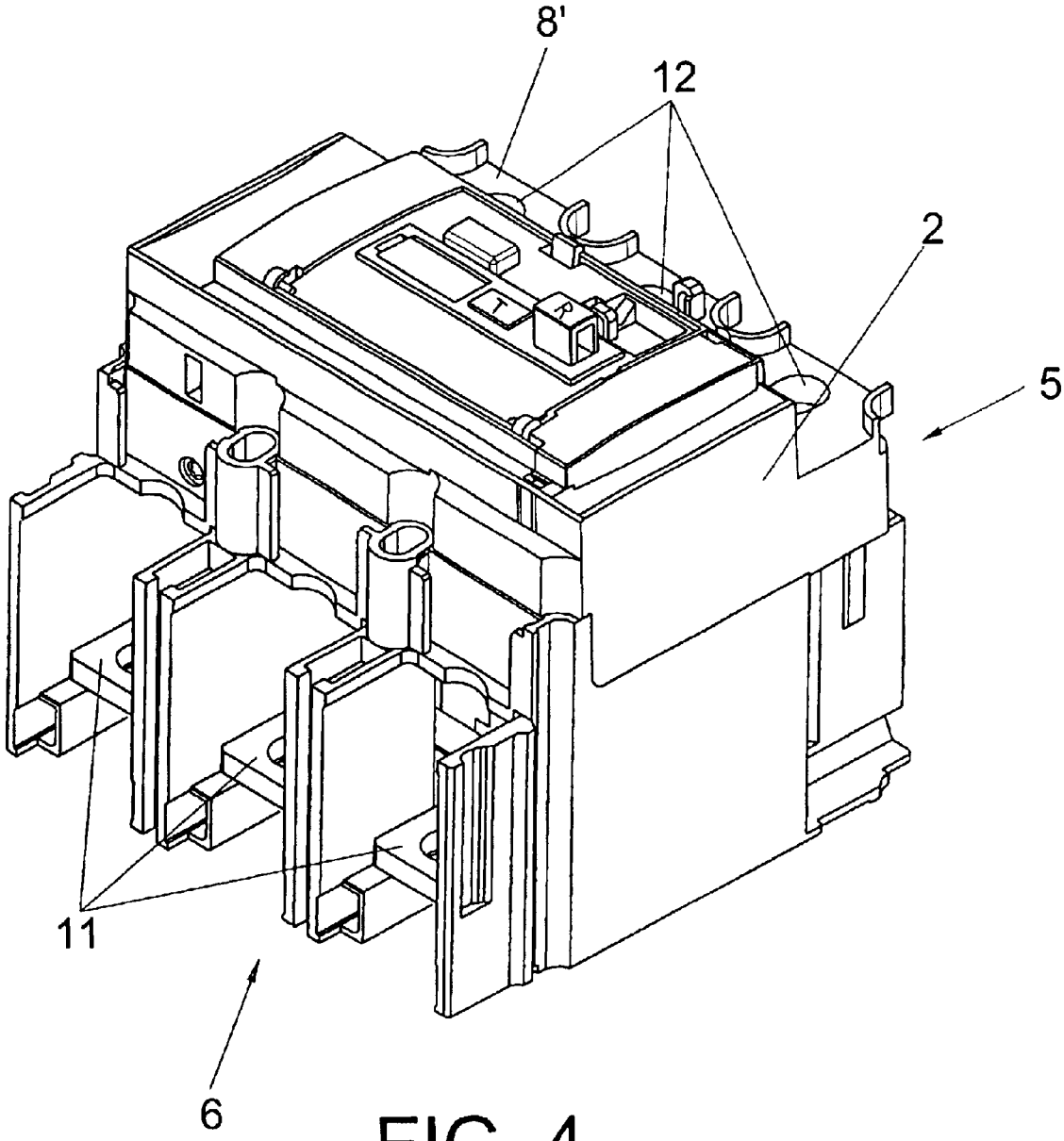
FIG. 4. Showing a perspective view of the part corresponding to the output connectors of the supplementary modules, exactly as it is sold, in other words, without the base and cover which must be removed from the basic module to e mounted in the output connector section of thee supplementary module shown in the figure.
Figure 5:
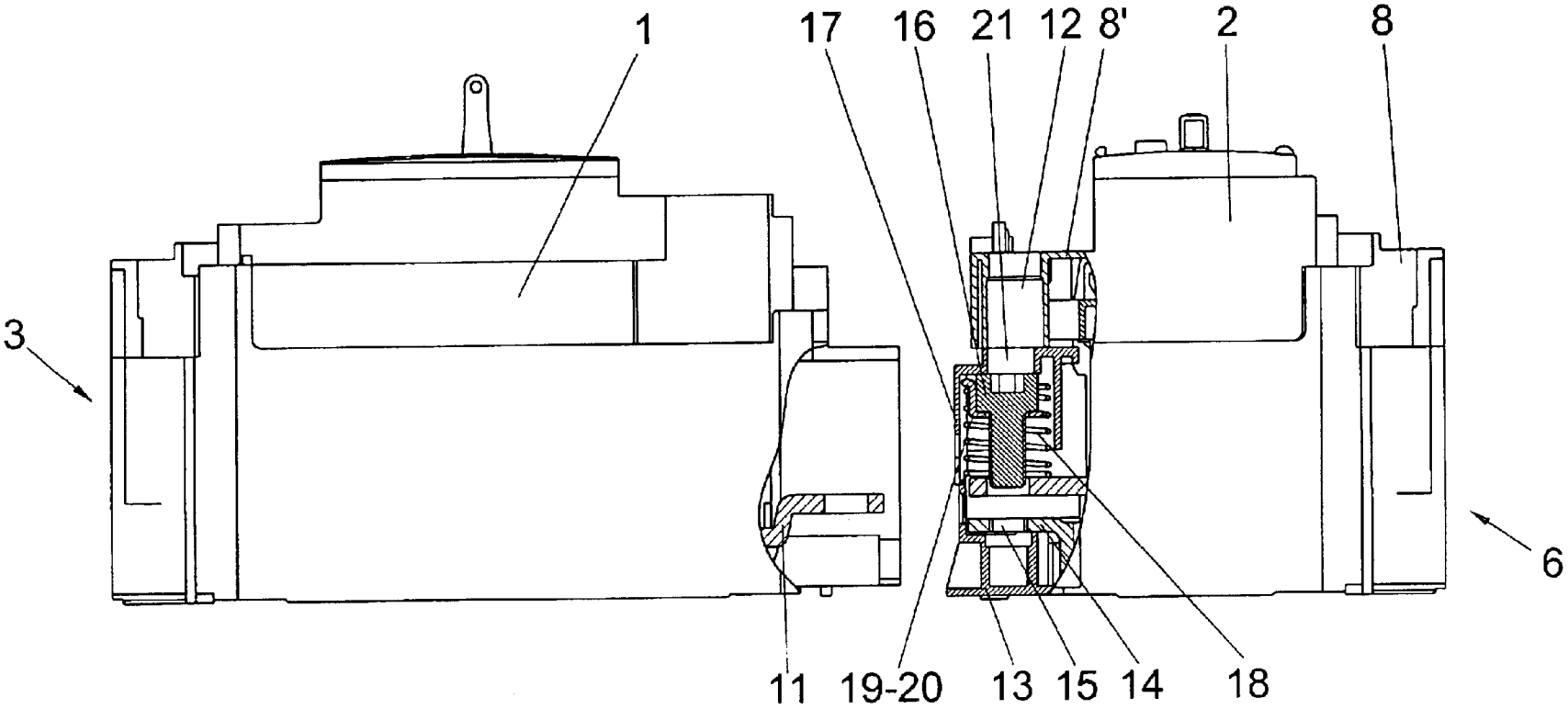
FIG. 5. Showing a side elevational view of the two modules facing one another and ready to be coupled to one another, showing the end parts of the coupling in cross-section in order to allow its basic components to be seen.
Figure 6:
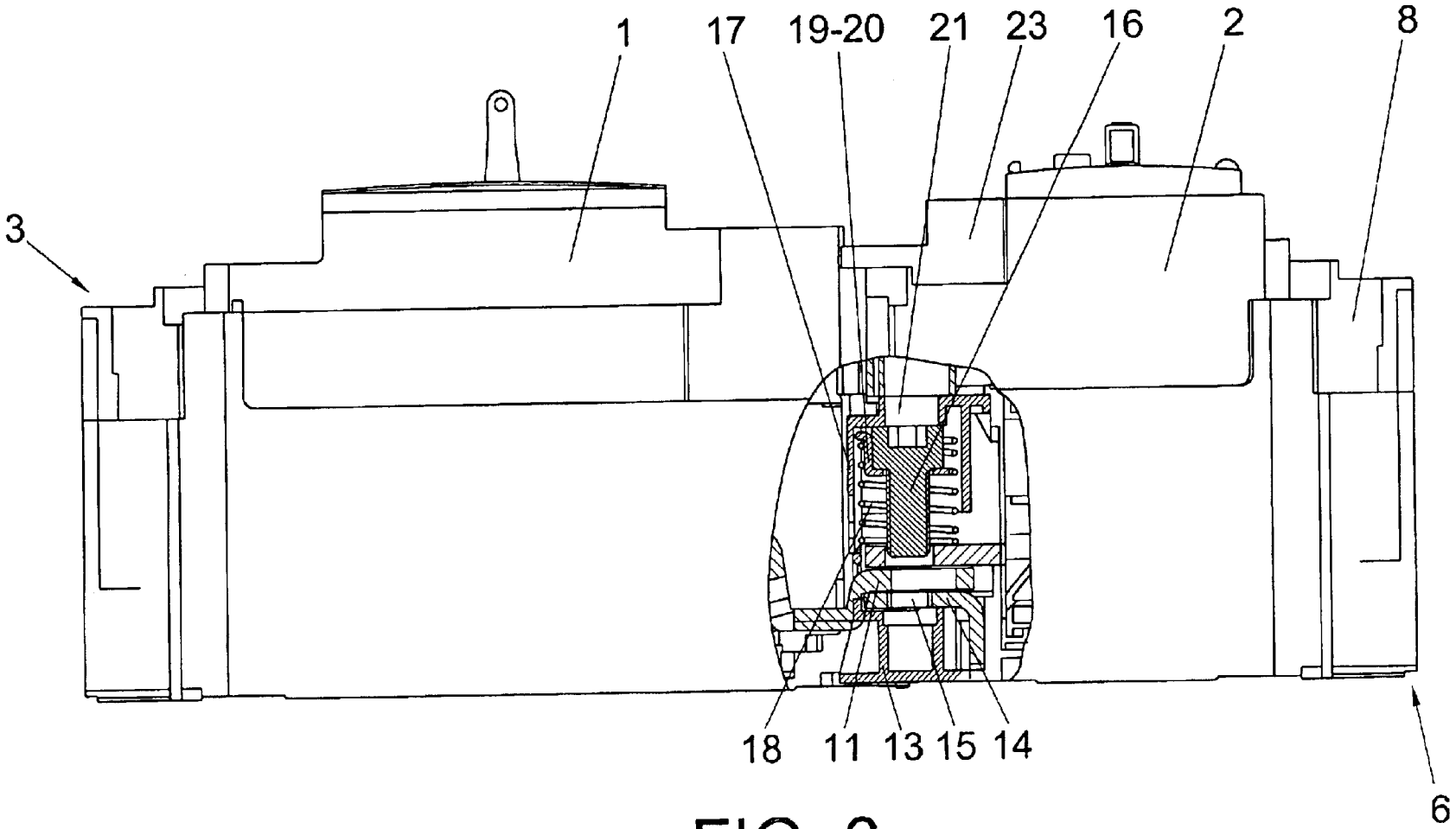
FIG. 6. Showing a view like that of the immediately preceding figure hereinabove with the two modules attached to one another.

In addition to the above, modules 1 and 2 are set facing one another and are attached to one another as shown from FIG. 3, such that, in this attachment, the terminals 11 of output connector section 4 of module 1 are arranged among the nuts 14 of said module 2 and respective strips located above, such that this attachment can easily be made, given that the screws 16 are pushed upward by the springs 18, in other words, always pre-positioned toward an open or raised position, retained by the washer 19, as in shown in FIGS. 5 and 6.

After this attachment has been made, the screws 16 are screwed into place by inserting the appropriate tool through the top hole 12 of the cover 8' and through hole 21 made in the protective cover 17, where the connectors comprised of said screws 16 are housed with the corresponding terminals. In this regard, the screw 16 runs through the corresponding holes of the terminals 11 and screw into the openings 15 of the nuts 14 corresponding to module 2, thus securing them into place.

For dismantling, it suffices to unscrew the screws 16, which, due to the effect of the springs 18, are pushed upward, releasing the terminals 11, making it possible to separate modules 1 and 2 from each other by simply pulling in the opposite direction.

As will possibly have been noted, both the assembly and dismantling processes can be performed simply, totally fast and without any type of problems, given that the setscrews or press screws 16 of the terminals are, when in a non-working position, are pushed upward or, what is the same, in open position, but facing the openings of the terminals and of the bolt of module 2 so that a simple push or turn thereof will screw it into opening 15 of the nut 14 of said module 2.

Figure 7:
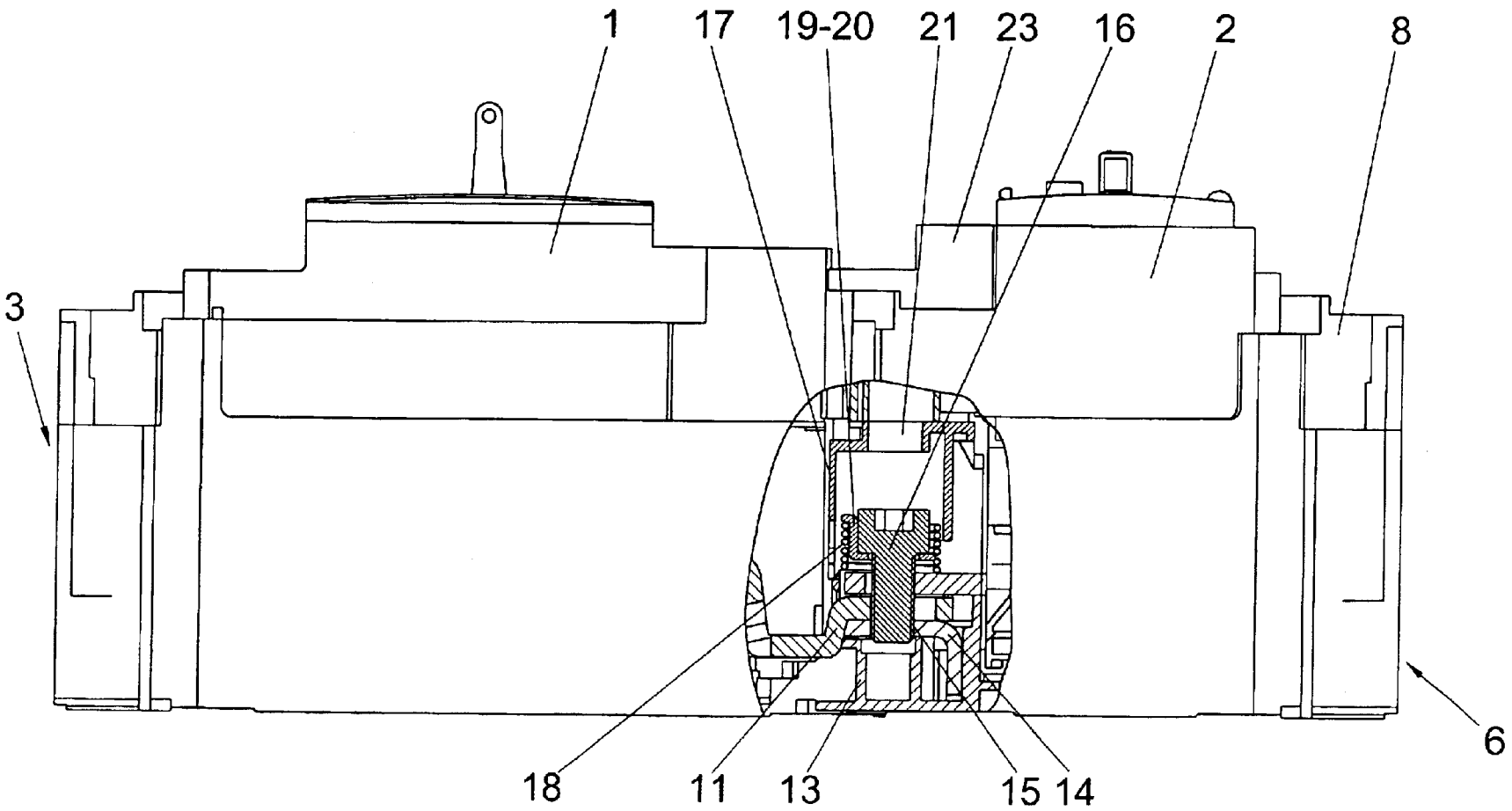
FIG. 7. Showing a view like that of the immediately preceding figure hereinabove with the screw screwed into the nut pertaining to the input connectors of the supplementary modules, the screw of which secures the corresponding terminal to the basic module.
Figure 8:
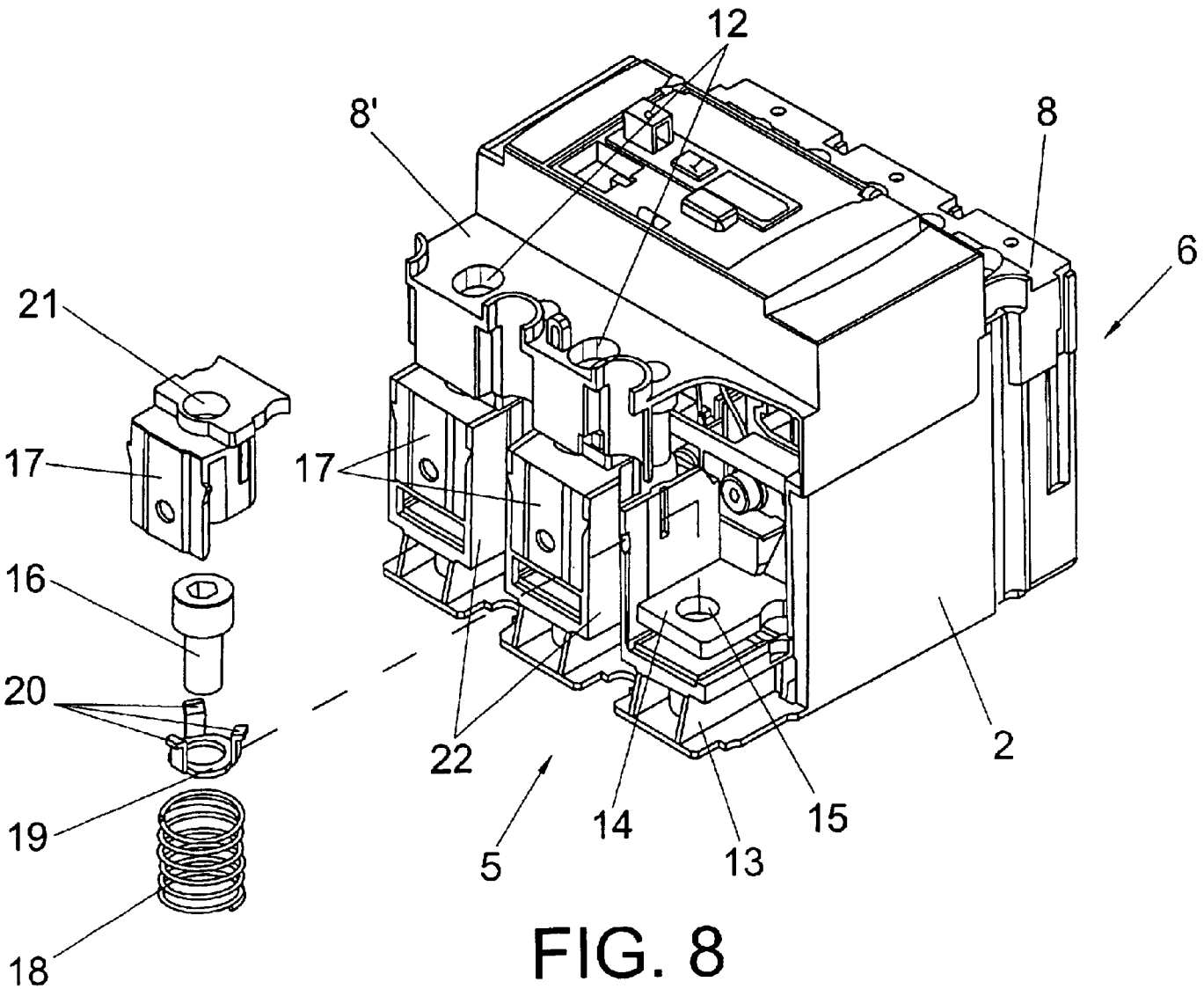
FIG. 8. Showing a perspective view of the supplementary module, along the part corresponding to the input connector section, with one of these connectors removed and blown up to allow the parts and components of which it is comprised to be seen.

Lastly, it must be said that the connection and attachment of modules 1 and 2 to one another, as shown in FIGS. 6 and 7 is supplemented with a cover 23 which, in addition to covering the upper connection section, is an element which serves to decorate the assembly between modules 1 and 2.

As has been previously stated hereinabove, by means of the aforementioned connection system, it is possible to connect and/or attach modules corresponding to electrical and/or electronic devices equipped with input and output connectors rapidly, affording the possibility of making a concatenated connection among an undetermined number of modules, which, in a preferred embodiment, can take the form of a differential line-to-ground fault protection relay and an automatic circuit breaker.

What is claimed is:

1. FAST CONNECTING SYSTEM FOR ELECTRICAL OR ELECTRONIC DEVICES WITH INTERCHANGEABLE COMMON ELEMENTS, intended to electrically attach and connect a plurality of modules of different types to one another, in which said modules have an input connector section and an output connector section, wherein a connection and assembly is accomplished by means of the output connector section of a first module and of the input connector section of a second module, said first and said second modules being provided with bases in which nuts are set for screwing setscrews of terminals corresponding to the input and output connectors, said first and said second modules being provided with protective covers for said connectors, wherein the base and protective cover of the second module are reproduced and integrated in the input connector section of the first module, said base and cover being interchangeable to be mounted in the output connector section of the second module; the protective cover of the input connector section of the second module being integrated therein.

2. FAST CONNECTING SYSTEM FOR ELECTRICAL OR ELECTRONIC DEVICES WITH INTERCHANGEABLE COMMON ELEMENTS according to claim 1, wherein the first and second modules are preferably materialized by means of a switch and by a differential breaker relay to prevent chassis-ground current leaks, acting as electrical distribution circuits and/or equipment protecting means.

3. FAST CONNECTING SYSTEM FOR ELECTRICAL OR ELECTRONIC DEVICES WITH INTERCHANGEABLE COMMON ELEMENTS according to claim 2, wherein each one of the connectors of the input connector section of the second module comprises an upside-down housing situated in a receptacle of the second module, in whose housing a setscrew of a terminal corresponding to the first module is mounted for the connection and assembly of the first module to the second module, each one of the connectors of said input connector section of the second module also comprising a nut into which the screw is screwed, said screw being pushed towards an opening position by means of a spring, regarding which said screw is secured by means of a washer with prongs forming a housing to secure and guide said screw, keeping said screw above a section where the terminal belonging to the first module is located, facing openings in order to allow said screw to be screwed once the assembly has been accomplished.

4. FAST CONNECTING SYSTEM FOR ELECTRICAL OR ELECTRONIC DEVICES WITH INTERCHANGEABLE COMMON ELEMENTS according to claim 1, wherein each one of the connectors of the input connector section of the second module comprises an upside-down housing situated in a receptacle of the second module, in whose housing a setscrew of a terminal corresponding to the first module is mounted for the connection and assembly of the first module to the second module, each one of the connectors of said input connector section of the second module also comprising a nut into which the screw is screwed, said screw being pushed towards an opening position by means of a spring, regarding which said screw is secured by means of a washer with prongs forming a housing to secure and guide said screw, keeping said screw above a section where the terminal belonging to the first module is located, facing openings in order to allow said screw to be screwed once the assembly has been accomplished.

* * * * *